United States Patent [19]

Miller

[11] Patent Number: 4,987,524

[45] Date of Patent: Jan. 22, 1991

[54] LAMP SHADE WITH IMPROVED OPTICAL EFFICIENCY

[76] Inventor: Jack V. Miller, 700 N. Auburn Ave., Sierra Madre, Calif. 91024

[21] Appl. No.: 270,349

[22] Filed: Oct. 17, 1988

[51] Int. Cl.[5] ..... F21V 11/00

[52] U.S. Cl. ..... 362/355; 362/356; 362/361

[58] Field of Search ..... 362/355, 356, 357, 361, 362/351

[56] References Cited

U.S. PATENT DOCUMENTS

| | | | |
|---|---|---|---|
| 589,489 | 9/1897 | Wolff | 362/361 |
| 2,714,155 | 7/1955 | Johnson | 362/356 X |
| 3,308,290 | 3/1967 | Brown | 362/357 X |
| 4,410,932 | 10/1983 | Oster | 362/355 X |
| 4,463,410 | 7/1984 | Mori | 362/355 X |

FOREIGN PATENT DOCUMENTS

| | | | |
|---|---|---|---|
| 990254 | 4/1965 | United Kingdom | 362/356 |

*Primary Examiner*—Stephen F. Husar

[57] ABSTRACT

A lamp shade is provided in the form of a translucent material in a generally tubular shape disposed about the vertical axis of a light source. The shade has an optical transmittance in the horizontal plane passing through the centroid of the light source, and a greater optical transmittance through the portion of the shade extending below the horizontal plane. A preferred embodiment controls the optical transmittance providing variable reflectance on the inner surface of the shade, and includes a generally reflective upper end closure having a means for supporting the shade, and a generally reflective convex cone below the light source.

19 Claims, 5 Drawing Sheets

LAMP SHADE WITH IMPROVED OPTICAL EFFICIENCY

BACKGROUND OF THE INVENTION

For many years the commonly used lamp shade has consisted of little more than a diffusing cylinder surrounding a compact light source, such as a light bulb. The shade has been regarded as a functional necessity to cover the excessive direct horizontal glare from the light source, usually called disability glare. Shades have sometimes been provided with ornamentation in the interest of aesthetics. Lamp shades for the table lamps, floor lamps and swag lamps, known in the lighting industry as portable lamps, have little or no optical design to improve the quality and efficiency of the light produced.

Conversely, the commercial lighting fixture industry has become very sophisticated in the development of diffusers for recessed and surface mounted lighting fixtures. Precise definition of direct horizontal glare control has been achieved, and is comparatively measured in terms of "Visual Comfort probability" (VCP). Also there has been acceptance of a measure of lighting quality with respect to reflected glare in terms of "Equivalent Sphere Illumination" (ESI). Fixtures are no longer rated by raw lamp lumen output, but are part of an overall lighting system design that maximizes the usefulness of the light to reduce the energy input.

The costs of energy, and indeed legislation that limits the wattage allowable per square foot of building, has increased the use of "Task Lighting" in commercial and industrial applications, applying relatively high light levels to desks while reducing the light level in surrounding room areas. In order to provide adequate task illumination, a typical task light now consists of a four foot long fluorescent fixture that is horizontally mounted on vertical supports on a desk. The net result is usually excessively high illumination levels and reflected glare on the desk in an ugly installation.

The purpose of the present invention is to provide a highly efficient lamp shade that will permit the use of portable lamps to create energy efficient and optically correct lighting for improved visual performance in both residential and commercial lighting. A second purpose of the present invention is to provide a decorative lamp shade that is an attractive addition to portable lamps, such as table, floor or swag lamps. A third purpose of the present invention is to provide effective control of both horizontal and reflected glare from the light source.

SUMMARY OF THE INVENTION

A lamp shade for a light source is of translucent generally tubular shape and partially enclosing a light source. A portion of the shade in the horizontal plane through the light source has an optical transmittance low enough to limit direct glare in the horizontal plane. The portion of the shade extending above the horizontal plane of the light source has at least as great an optical transmittance, and the portion of the shade extending below the horizontal plane has an optical transmittance greater than the portion of the shade in the plane of the light source. A preferred embodiment also has an optical transmittance that is equal to the reciprocal of the footcandle level at the inside shade surface, whereby the external shade surface has approximately a constant luminance in footlamberts.

Another preferred embodiment provides a top end closure including a concave reflector that directs light from the source to the lower portion of the shade having highest optical transmittance.

Yet another preferred embodiment provides an upper concave reflector that limits the brightness at zenith.

Yet another preferred embodiment provides a lower convex reflector that limits the brightness at nadir.

DETAILED DESCRIPTION OF THE DRAWINGS

Figure 1:
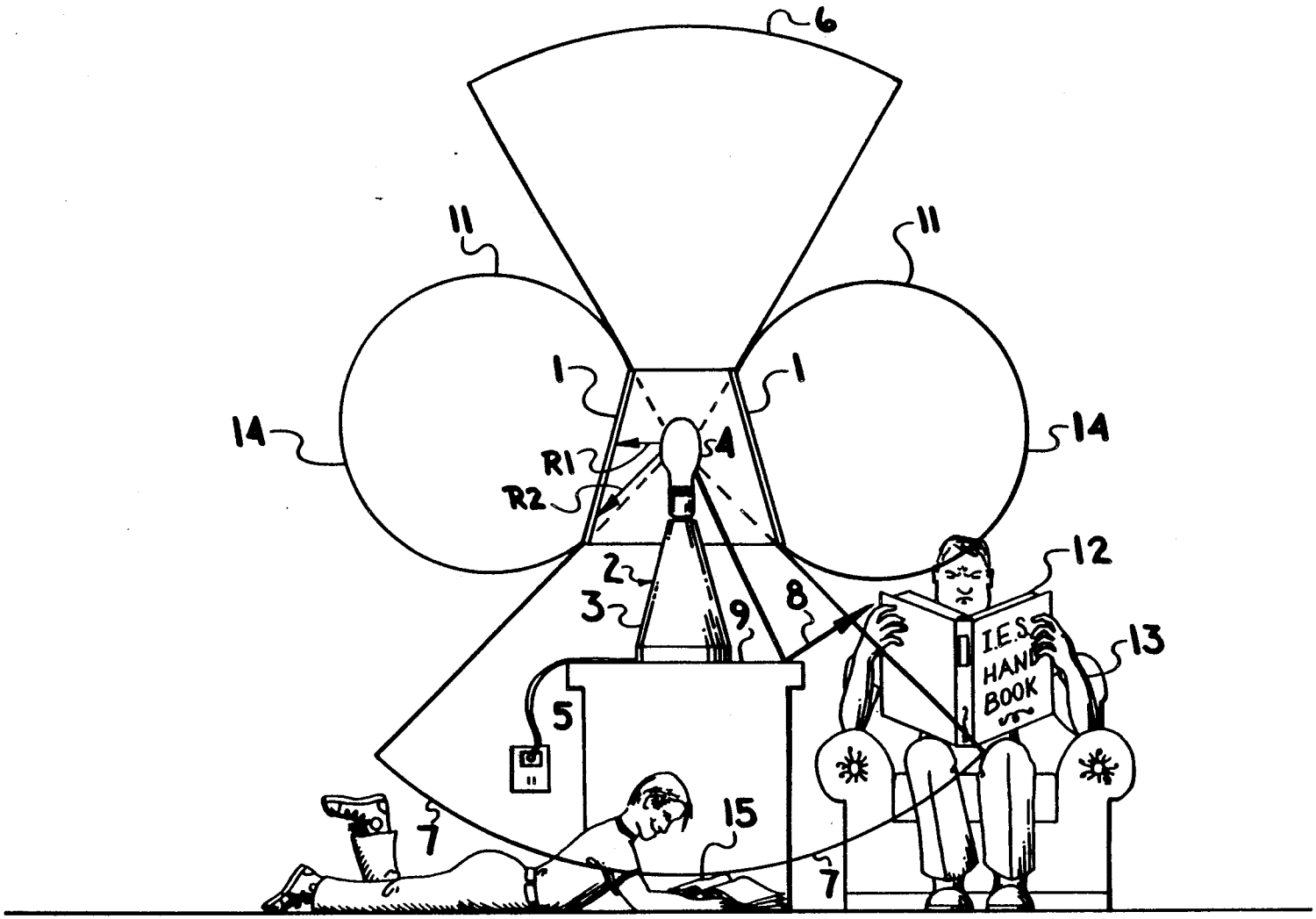
FIG. 1 PRIOR ART
FIG. 1 is an elevation view of a prior art lamp and shade in a typical use environment.

In FIG. 1 a prior art shade 1 on a portable table lamp 2 is shown in a typical residential use and having base 3 with a light source 4 connected to a source of external power 5. Direct illumination from source 4 extends upwards in a photometric intensity level 6 measurable in footcandles generally following the inverse square law. Direct illumination from source 4 extends downwards in a photometric intensity level 7 also measurable in footcandles and following the inverse square law. Illumination from source 4 strikes a prior art diffusing shade 1 also following the inverse square law whereby incident light intensity varies by the square of the distance R to the shade. Therefore if R2 is twice the distance R1, the incident light at R1 is 4 times the incident light at R2. This will emphasize the peak 14 of horizontal brightness produces by the shade, shown diffused in generally Lambertian or cosine distribution 11.

A typical reading task 12 in the normal position of a seated user 13 is normally above the circle of direct downward illumination 7, and is below the peak 14 of cosine distribution from the lampshade 1, whereby the seated user has the reading task positioned in the lowest illumination level in the entire photometric distribution pattern. The full use of the downward direct illumination 7 is employed on a reading task 15 on the floor, but that is not a convenient normal adult use of the lamp. The peak 14 of the cosine distribution represents horizontal brightness that is generally considered direct disability glare that inhibits visual performance in lighting installations. Visual performance is often further inhibited by reflected glare rays 8 from a table surface 9, and from excessively high contrast ratios on surface areas of the ceiling and walls.

Figure 2:
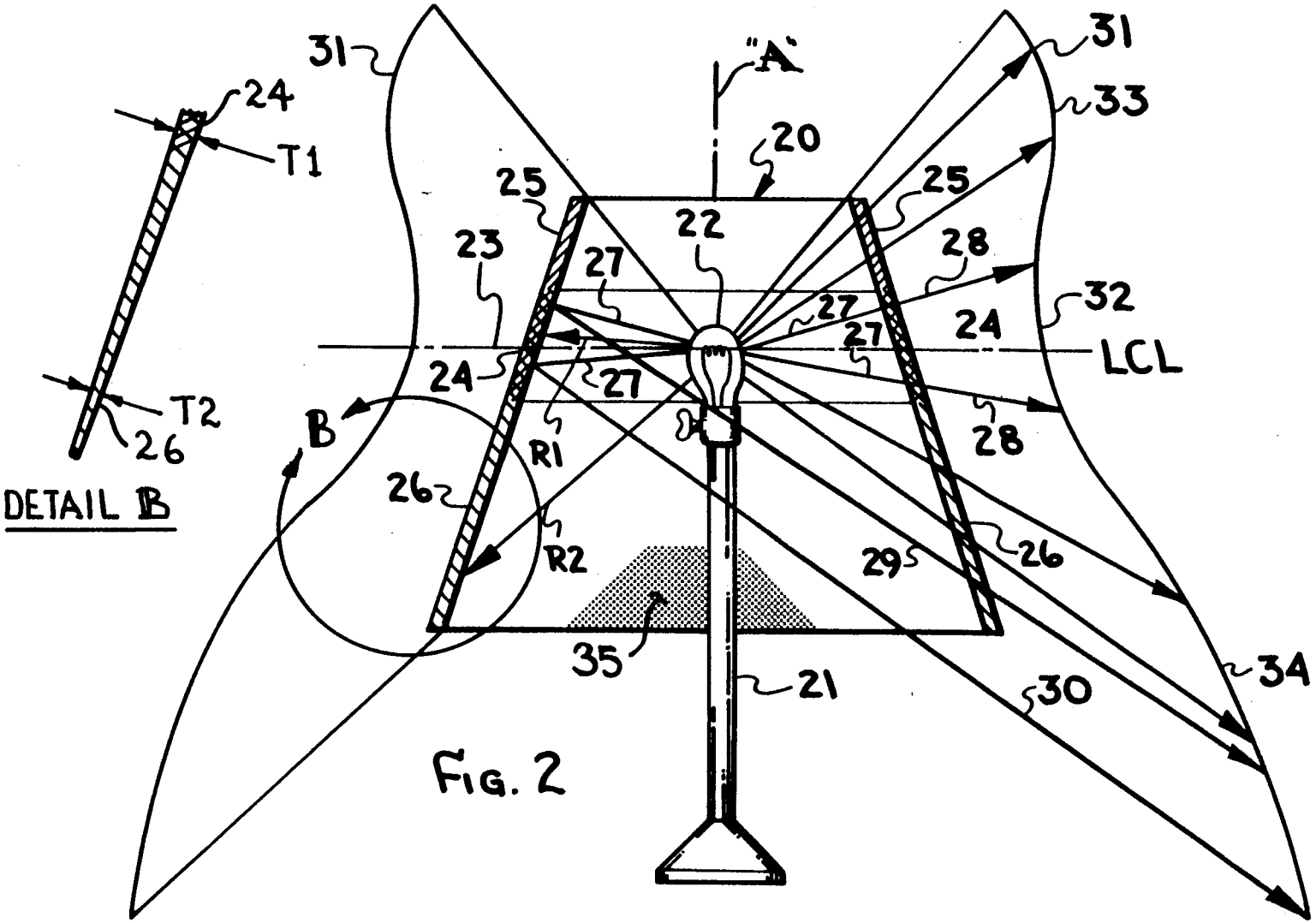
FIG. 2 is a cross-sectional elevation view of a lamp employing a shade according to the present invention.

In FIG. 2 a generally tubular translicient shade 20 shade disposed about a vertical axis "A" according to the present invention is shown on a portable lamp 21 partially enclosing a light source 22 generally in a horizontal plane 23 usually identified as "LCL" or light centerline of the centroid of luminance. Shade 20 is provided with a central portion 24 of relatively low optical transmittance and relatively high internal reflectance in a band generally in the horizontal plane of the light centerline, an upper portion 25 of relatively higher transmittance, and a lower portion 26 of still higher transmittance. Relatively low transmittance of central portion 24 and relatively higher transmittance of portions 26 and 26 may be produced for a sheet of translucent material of constant thickness and having varying optical density is greater in portion 24 than in portions 25 and 26. Relatively low transmittance of central portion 24 and relatively higher transmittance of portions 26 and 26 may also be produced by another method for a sheet of translucent material of constant thickness, and in which the internal surface has a reflectance greater in portion 24 than in portions 25 and 26. A preferred method of varying the reflectance of the internal surface of the shade is by printing the inside surface with a reflective pattern 35 in the form of a half-tone screen having greater density in portion 24 than in portions 25 and 26. The density of the half-tone pattern may be made proportional to the incident illumination, whereby the transmittance through the shade in an axial plane is approximately constant, producing a uniform external shade brightness in footlamberts.

Another preferred method of varying the reflectance of the internal surface of the shade is shown in DETAIL B of FIG. 2, in which the photometric distribution is controlled by making the shade of a translucent material of relatively homogeneous optical density, and having a thickness varying from $T_1$ to $T_2$ at portions 24 and 26, respectively; the varying thickness made generally proportional to the incident illumination, whereby the transmittance through the shade in an axial plane is approximately constant, producing a generally uniform external shade brightness in footlamberts. Rays 27 from source 22 striking the central low transmittance portion 24 are attenuated and emerge as low brightness rays 28. Rays 27 from source 22 which are reflected from portion 24 form rays 29 passing through the higher transmittance portion 26 and rays 30 passing outside the shade. Therefore the photometric distribution curve 31 produced by lampshade luminance has low horizontal brightness in a valley 32 that reduces direct disability glare to the observer, a generally upward 45° peak 33 that contributes to background room illumination, and a downward 45° peak 34 that is at the ideal reading task angle.

For clarity of description low transmittance portion 24, higher transmittance portion 25 and higher transmittance portion 26 are shown as distinct bands. Preferred embodiments for both functional and aesthetic reasons would blend the areas into smoothly blending changes from low transmittance and high relative reflectance along the LCL plane, gradually changing to higher transmittance and lower reflectance with greater axial distances above and below the LCL. Since the incident illumination level on the inside of the shade will vary by $1/R^2$, the transmittance of the shade is varied by at least the ratio of $R1^2$ to $R2^2$ to produce a constant shade luminance, and a greater ratio of transmittance to reduce the luminance in the horizontal plane. Since the foot-candle level Fc on the inside shade surface is proportional to the square of the distance of the light source, then a transmittance through the shade at any point of 1/Fc would produce an outside shade luminance in footlamberts that would be constant in any axial plane.

The light source 42 is illustrated as an incandescent bulb for clarity of description. There are a number of gas discharge sources, such as circular and U-shaped compact fluorescent lamps that are equally applicable to the embodiments illustrated. All such sources, including the incandescent lamps have a luminous volume of some size, and therefore the descriptions herein are consistent with the terminology of planes through the centroids of luminance.

Figure 3:
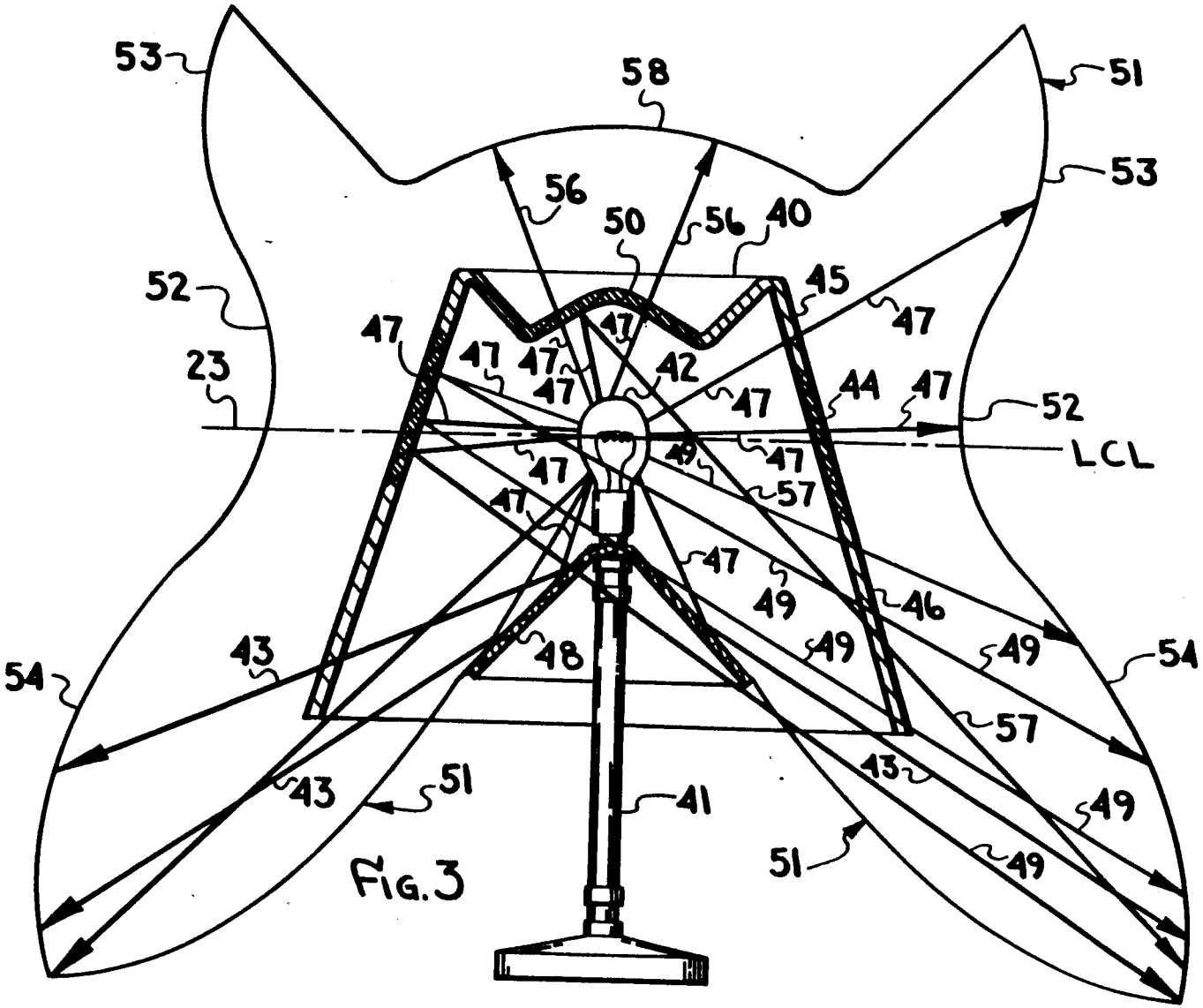
FIG. 3 is a cross-sectional elevation view of an incandescent portable lamp employing a shade according to the present invention and including a concave upper end reflector.

In FIG. 3 a shade 40 according to a preferred embodiment of the present invention is shown on a portable lamp 41 having a light source 42 generally in the LCL horizontal plane 23. Shade 40 is provided with a central portion 44 of relatively low optical transmittance and relatively high internal reflectance in a band generallY in the horizontal plane of the light centerline, an upper portion 45 of relatively higher transmittance, and a lower portion 46 of still higher transmittance. Rays 47 from source 42 striking the central low transmittance portion 44 are attenuated and emerge as low brightness rays 48. Rays 47 from source 42 which are reflected from portion 44 form rays 49 passing through the higher transmittance portion 46 and also passing outside the shade. Therefore the photometric distribution curve 5! produced as lampshade luminance has low horizontal brightness in a valley 52 that reduces direct disability glare to the observer, a generally upward 45° peak 53 that contributes to background room illumination, and a downward 45° peak 54 that is at the ideal reading task angle.

Since at every point of transmittance there is also a reflected ray, direct rays from the source 42 and striking portion 44, 45 and 46 of the shade 40 not only are transmitted through and attenuated by the shade, but are also partially reflected in approximately the reciprocal of the transmittance. Therefore a portion of rays 47 are reflected as rays 49 substantially passing through the most transmissive portion 54 of shade 40, and passing beneath shade 40. The direct rays 47 that are emitted upwards by source 42 strike a substantially reflective concave reflector 50 which is generally in the shape of a concave cone, whereby the upwards rays 47 are reflected as rays 57 passing through the most transmissive portion 54 of shade 40. The direct rays 47 that are emitted generally downwards by source 42 strike a substantially reflective male conical reflector 48 whereby the downwards rays 47 are reflected as rays 43 passing through the most transmissive portion 46 and passing beneath shade 40.

Therefore the photometric distribution curve 51 produced as lampshade luminance still has low horizontal brightness in a valley 52 that reduces direct disability glare to the observer, a generally upward 45° peak 53 that contributes to background room illumination, and a more dominant downward 45° peak 54 that is accentuated by the addition of the internally reflected rays at the ideal reading task angle.

Figure 4:
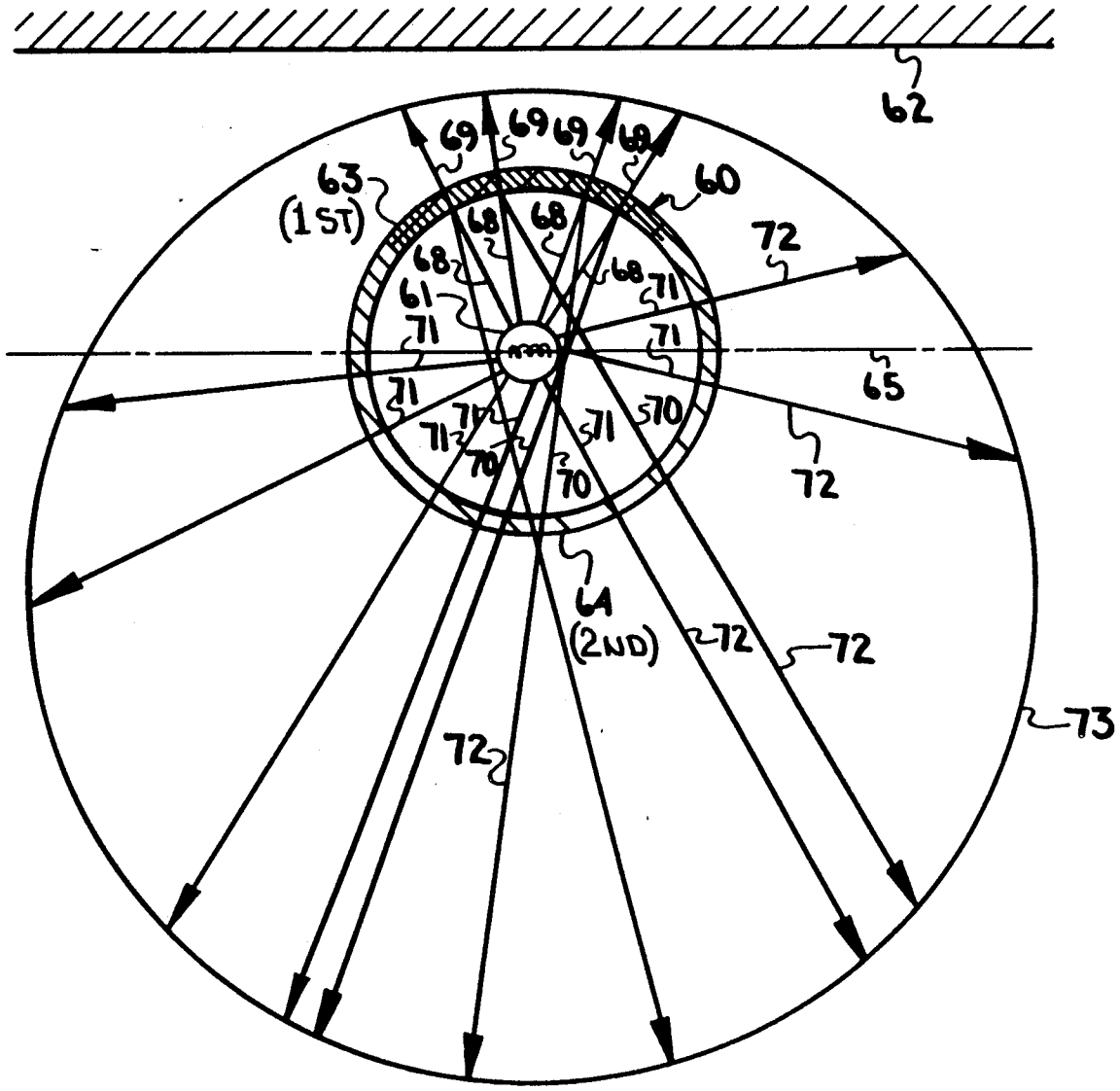
FIG. 4 is a cross-sectional plan view of a portable lamp employing a shade according to a preferred embodiment in which transmittance is radially varied.

In FIG. 4 a lamp shade 60 is shown in cross section having a generally tubular shape that may be cylindrical, a truncated cone or other tubular figure of revolution coaxially disposed about a light source 61, and is shown adjacent to a room wall 62. Since most room walls are about 50% reflective, approximately half of the light striking the wall will be absorbed and not reflected back into the room as useful light. Shade 60 according to an embodiment of the present invention is shown to have its tubular shape comprising a first side 64 and a second side 63 either side of a vertical plane 65 which is generally parallel to a wall.

Second side 63 has relatively low transmittance and high reflectance, whereby rays from light source 61 striking the shade's second side 63 emerge as attenuated rays 69, and are substantially reflected as rays 70, which combine with direct rays 71 from the light source to substantially pass through the relatively higher transmittance second side 64 to produce even stronger rays 72, the radially varied transmittance pattern thereby creating a non-circular and radially varied photometric output 73, which is asymmetrically shaped according to the placement and gradual blending of transmittance and reflectivity from the first side to the front half of the shade. This embodiment therefore removes the wall reflectance values from the lighting levels, and permits the more optimum use of the lumen output of the source to perform visual tasks.

Figure 5:
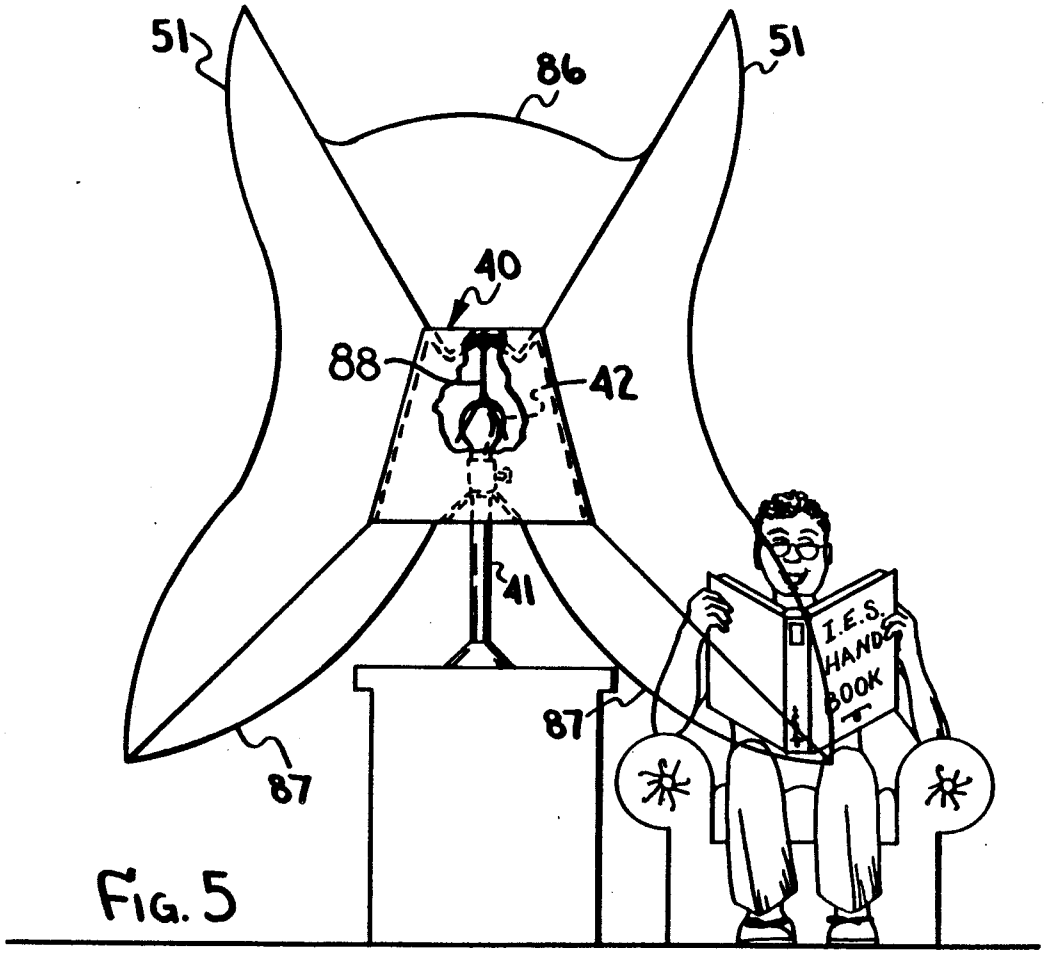
FIG. 5 is a cross-sectional elevation view of a lamp and shade according to the present invention in a typical use environment.

In FIG. 5 the lamp shade 40 of FIG. 3 is shown on portable table lamp 41 in a typical residential use. Direct illumination from source 42 extends upwards in a photometric intensity level 86 measurable in footcandles generally following the inverse square law. Direct illumination from source 42 extends downwards in a photometric intensity level 87 also measurable in footcandles and following the inverse square law. Photometric distribution 51 from the surface of shade 40, as previously described in FIG. 3, is contiguous with levels 86 and 87, respectively to produce nearly an ideal task lighting photometric distribution having soft ceiling illumination through relatively low transmittance in the zenith direction, low horizontal brightness to reduce disability glare, reduced reflections on the table surface due to relatively low transmittance in the nadir direction and a strong 45° downwards conical beam to maximize task performance. A means for supporting the lamp shade on the lamp is shown in FIG. 5 as a spring clamp 88 on the bulb. Many forms of harps are common in the industry. A harp may support either the top or bottom of the shade from the bulb, lampholder or any other structural part of the lamp. Any of these common prior art devices would be applicable to the shade of the present invention as a means of support.

What is claimed:

1. A lamp shade for a light source comprising:

a translucent generally tubular shape and adapted to be disposed about a vertical axis and partially enclosing at least one light source having a centroid of luminance;

a portion of the shade in a horizontal plane generally through the centroid of luminance of the light source and having an optical transmittance through the shade surface;

a portion of the shade extending above the horizontal plane through the centroid of luminance of the light source and having an optical transmittance through the shade surface at least as great as the portion of the shade in the plane of the centroid of luminance of the light source; and a portion of the shade extending below the horizontal plane through the centroid of luminance of the light source and having an optical transmittance through the shade surface greater than the optical transmittance through the portion of the shade in the horizontal plane of the centroid of luminance of the light source.

2. A lamp shade according to claim 1 in which the shade surface is a sheet of translucent material of constant thickness and varying optical density.

3. A lamp shade according to claim 1 in which the shade surface is a sheet of translucent material of constant thickness and a means for varying internal reflectance.

4. A lamp shade according to claim 1, 2 or 3 in which the shade has a gradual axially varied transmittance pattern along the vertical axis.

5. A lamp shade according to claim 3 in which the means for varying internal reflectance is a printed reflective half-tone screen pattern.

6. A lamp shade according to claim 1 in which the generally tubular shape is cylindrical.

7. A lamp shade according to claim 1 in which the generally tubular shape is a truncated cone.

8. A lamp shade according to claim 1 in which the generally tubular shape has an upper end closure means.

9. A lamp shade according to claim 8 in which the upper end closure means is in part a generally conical, concave reflector.

10. A lamp shade according to claim 1 in which a male, conical reflector is disposed below the light source.

11. A lamp shade according to claim 10 in which light from the light source striking the concave reflector is reflected to the portion of the shade below the horizontal plate through the centroid of luminance of the light source.

12. A lamp shade according to claim 1, 2 or 3 in which the shade has a transmittance pattern that has gradual radially varied transmittance about he vertical axis.

13. A lamp shade for a light source comprising:

a translucent generally tubular shape and adapted to be disposed about a vertical axis and partially enclosing at least one light source having a centroid of luminance;

a portion of the shade in the horizontal plane generally through the centroid of luminance of the light source and having an optical transmittance through the shade surface;

a portion of the shade extending above the horizontal plane through the centroid of luminance of the light source and having an optical transmittance through the shade surface greater then the portion of the shade in the plane of the centroid of luminance of the light source; and a portion of the shade extending below the horizontal plane through the centroid of luminance of the light source and having an optical transmittance through the shade surface greater than the optical transmittance through the shade surface of the portion of the shade in the plane of the centroid of luminance of the light source.

14. A lamp shade according to claim 13 in which the optical transmittance varies axially among the vertical axis by at least $R^2$, where R is the distance from the light source to the surface of the shade.

15. A lamp shade according to claim 13 in which the optical transmittance varies axially along the vertical axis by 1/Fc where Fc is the footcandle level from the light source at any point on the inner surface of the shade, and the outside surface shade luminance fL in footlamberts is constant in an axial plane.

16. A lamp shade for a light source comprising:

a translucent generally tubular shape and adapted to be disposed about a vertical axis and partially enclosing at least one light source having a centroid of luminance;

a portion of the shade in the horizontal plane generally through the centroid of luminance of the light source and having an optical transmittance through the shade surface a portion of the shade extending above the horizontal plane through the centroid of luminance of the light source and having an optical transmittance through the shade surface greater than the portion of the shade in the plane of the centroid of luminance of the light source;

an upper end closure portion of the shade comprising an at least partial reflector;

a portion of the shade extending below the horizontal plane through the centroid of luminance of the light source and having an optical transmittance greater than the portion of the shade in the plane of the centroid of luminance of the light source.

17. A lamp shade according to claim 8 or 16 in which the upper end closure is provided with a means for supporting the shade with respect to the light source.

18. A lamp shade according to claim 16 in which the optical transmittance varies axially by 1/Fc where Fc is the footcandle level from the light source and reflector at any point on the inner surface of the shade, and the outside surface shade luminance fL in footlamberts is constant in an axial plane.

19. A lamp shade according to claim 16 in which the transmittance is radially varied about the vertical axis and has a higher transmittance through a first side of the tubular shape, and a lower transmittance through the second and diametrically opposite side of the tubular shape.

* * * * *